US006308388B1

(12) United States Patent
Haider

(10) Patent No.: US 6,308,388 B1
(45) Date of Patent: Oct. 30, 2001

(54) TEXTURING JET

(75) Inventor: Bruno Haider, Gmunden (AT)

(73) Assignee: SML Maschinengesellschaft m.b.H. (AT)

( * ) Notice: Subject to any disclaimer, the term of this patent is extended or adjusted under 35 U.S.C. 154(b) by 0 days.

(21) Appl. No.: 09/753,382

(22) Filed: Jan. 3, 2001

(51) Int. Cl.[7] ..... D02J 11/02
(52) U.S. Cl. ..... 28/271; 28/247
(58) Field of Search ..... 28/271, 272, 273, 28/274, 275, 276, 254; 57/289, 333, 350

(56) References Cited

U.S. PATENT DOCUMENTS

| | | | | |
|---|---|---|---|---|
| 3,638,291 | | 2/1972 | Yngve . | |
| 3,710,460 | * | 1/1973 | Segraves | 28/271 |
| 4,949,441 | | 8/1990 | Ethridge . | |
| 5,119,623 | * | 6/1992 | Fetzer et al. | 57/333 |

FOREIGN PATENT DOCUMENTS

| | | | | |
|---|---|---|---|---|
| 3019302 | | 11/1981 | (DE) . | |
| 38 29 150 | | 3/1990 | (DE) . | |
| 3829150 | * | 3/1990 | (DE) | 28/271 |
| 39 27 910 | | 2/1991 | (DE) . | |
| 3927910 | * | 2/1991 | (DE) | 28/271 |
| 0495886 | | 5/1995 | (EP) . | |

* cited by examiner

*Primary Examiner*—Danny Worrell
(74) *Attorney, Agent, or Firm*—Samuels, Gauthier & Stevens

(57) ABSTRACT

A texturing jet arrangement for treatment of a filamentary material. The arrangement includes at least two superimposed body members. A treatment duct formed in at least one of the body members extends between the superimposed body members. At least one jet body for feeding a gaseous treatment medium and at least one vent portion is provided in the treatment duct. The treatment duct includes at least a partial region with a material that is more wear-resistant than the material of the body member.

12 Claims, 6 Drawing Sheets

TEXTURING JET

FIELD AND BACKGROUND OF THE INVENTION

The invention relates to a texturing jet for treating a filamentary material in a treatment duct formed between at least two superimposed body members, including at least one jet body for feeding a gaseous treatment medium and at least one vent portion provided in the treatment duct.

Multifilaments are threads made of synthetic polymers such as, for instance, polypropylene, polyamide, polyester or the like, which are applied in the most diverse fields. Apparatus for the production of multifilament threads comprise an extruder in which the starting material in granulate form is melted and pressed through a spinneret. Depending on the number of filaments desired per thread, the spinneret comprises the respective number of holes through which the synthetic material is pressed. Besides round cross sections, the holes of the spinneret may also have other cross sectional shapes in order to impart special properties on the filaments. The extrusion procedure is followed by a cooling process, after which the filaments are united to a thread. Depending on the purpose of use of the thread, various drawing processes, texturing processes and cooling processes follow, where-upon the yarn is finally wound on appropriate bobbins. Texturing serves to impart specific properties on the synthetic fibers or woven fabrics or the like resulting therefrom. If the yarns are used for carpets, the synthetic fibers are, for instance, treated with hot compressed air so as to cause appropriate crimping of the yarn, yet without individual filaments being allowed to break or tear. Those processes are known in the art as BCF texturing (BCF= bulked continuous filaments). The present invention is related essentially to such BCF texturing. In that process, crimps are introduced into the drawn yarn by hot air texturing. The texturing jets are operated in a range of from 145 to 150° C. and at a pressure of 7 to 8 bars.

A texturing jet of the initially defined kind is described, for instance, in U.S. Pat. No. 4,949,441 A and the corresponding EP 495 886 B1. There, a filament yarn is sucked in through an injector and pulled downwards by the aid of hot air which is deflected accordingly. After this, the thread at a high speed and plastification temperature impinges on a tangle yarn plug within a chamber provided with a plurality of slots, thus being nonuniformly bent a great number of times, i.e., crimped. After texturing, the yarn is conducted over suitable cooling drums for cooling and, usually in a further step, is subsequently intermingled, which means that knobs are introduced so as to cause the filaments to be fixed within the yarn before the yarn is wound on appropriate bobbins. The texturing jet is comprised of a body member, a cover plate and an internal plate sandwiched therebetween and formed by a stack of laminae, one of which forms an elongate duct whose cross section changes both in breadth and in height between inlet and outlet. The body member is provided with two spaced-apart bores through which a fluid is fed for treating a strand material which is conducted through the duct. The stack-shaped laminate of the internal plate offers the advantage that only the duct-forming lamina will have to be replaced in the event of worn duct walls. However, the price paid for this advantage is the disadvantage that the construction of an internal plate including stacked laminae is highly demanding in respect to both production and mounting.

DE 30 19 302 A1 discloses a jet for intermingling yarns, which comprises a closed yarn travelling duct of rectangular cross section and gas feed ducts, wherein the duct widens stepwisely on one broadside or on both broadsides, the enlargements of the yarn travelling duct again narrowing to the original cross section.

U.S. Pat. No. 3,638,291 A describes a texturing jet in which the duct-forming body is comprised of but two parts whose oppositely arranged surfaces are plane, wherein the yarn travelling duct, which has a constant depth and includes lateral recesses, is formed in the surface of one of the bodies.

DE 38 29 150 A1 describes an air jet for pneumatic false twist spinning, which is comprised of several sections. The section that is arranged downstream of the section including the compressed air ducts is made of a harder, more wear-resistant material such as, e.g., ceramics.

DE 39 27 910 A1 describes a false twist spinneret provided for pneumatic false twist spinning, in which at least part of the inner wall of the blowing duct is provided with a coating or an insert made, for instance, of a ceramic material, in order to reduce the cross section of the exit opening.

The two last-mentioned documents describe spinning processes for staple fibers in which the yarn is not crimped or bulked, but stretched and formed into a lower-strength yarn within the air jet. The technology described in those documents, therefore, differs substantially from the technology underlying the present invention. Moreover, replacement of the inserts involves relatively high expenses.

SUMMARY OF THE INVENTION

It is the object of the invention to provide a texturing jet which stands out for its easy production, problem-free mounting and simple maintenance. It is to be feasible to readily and quickly exchange, in particular, the more sensitive and more rapidly worn components of the texturing jet. The texturing jet according to the invention is to enable the fabrication of yarns exhibiting characteristics as good as possible and also as symmetrical as possible. The adaptation of the texturing jet to different yarn qualities is to be feasible as quickly and simply as possible without having to exchange the entire texturing jet.

This object is achieved in that the treatment duct at least in partial regions is realized with a material that is more resistant than that of the body member.

Advantageously, the more resistant material is comprised of a ceramic material. Apart from its poorer workability, a ceramic material offers a great number of advantages.

According to another characteristic feature of the invention, the more resistant material is provided by an insert inserted in the body member. This enables worn components to be exchanged readily and quickly without having to replace the entire texturing jet. On the other hand, the texturing jet may be readily adapted to varying conditions such as, varying yarn characteristics, by replacing such inserts.

Alternatively, the more resistant material also may be provided by an attachment attached to the body member.

Advantageously, the jet body of the texturing jet is contained in the insert or in the attachment, respectively. It is exactly the jet body which constitutes a texturing jet component that is particularly prone to wear. Moreover, the yarn properties are decisively influenced by the jet body.

If the insert is resiliently mounted in the body member, the optimum closure will be reached as the body members constituting the texturing jet are being assembled.

Said resilience may be provided by indents realized in the insert.

In order to obtain as uniform a plug formation as possible and hence also uniform crimps as well as yarn properties, it is provided according to a further characteristic feature of the invention that the treatment duct has a square cross section in the vent portion with aeration windows formed by perforated plates or the like being provided on each side of the treatment duct. Due to the symmetrical configuration of the vent portion, a texturing air flow-off as symmetrical as possible and hence uniform yarn properties will be achieved. In addition, any undesired propagation of the twist will be effectively prevented.

If the perforated plates or the like are fastened to the body member by means of magnets, the latter may be exchanged in an accordingly simple and quick manner.

If, as in accordance with a further characteristic feature of the invention, a die part is connected to the runout of the treatment duct, or integrated in the texturing jet, for directly supplying to a cooling drum the filamentary material treated, the distance between the texturing jet and the cooling drum may be kept very short. Moreover, the speed of the plug may be controlled in a suitable manner via the speed of the cooling drum.

The texturing jet according to the invention provides for a flow control which, in conjunction with the exhaust air zone and the preferably square configuration of the treatment duct, results in a very compact plug with a most uniform plug density as well as a very high and uniform crimp in the yarn. The combination of such an optimal symmetrical plug formation with the subsequent cooling phase enables the production of yarns exhibiting very low shrinking values, also called heat shrinkage, ranging from 0.5% up to a maximum of 1%. This shrinkage is lower as compared to that of conventional BCF yarns, which usually ranges between 3% and 4%.

BRIEF DESCRIPTION OF THE DRAWINGS

The aforementioned and further characteristic features of the invention will be explained in more detail by way of the annexed drawings illustrating exemplary embodiments of the subject matter of the invention. Therein.

DETAILED DESCRIPTION OF PREFERRED EMBODIMENTS

Figure 1:
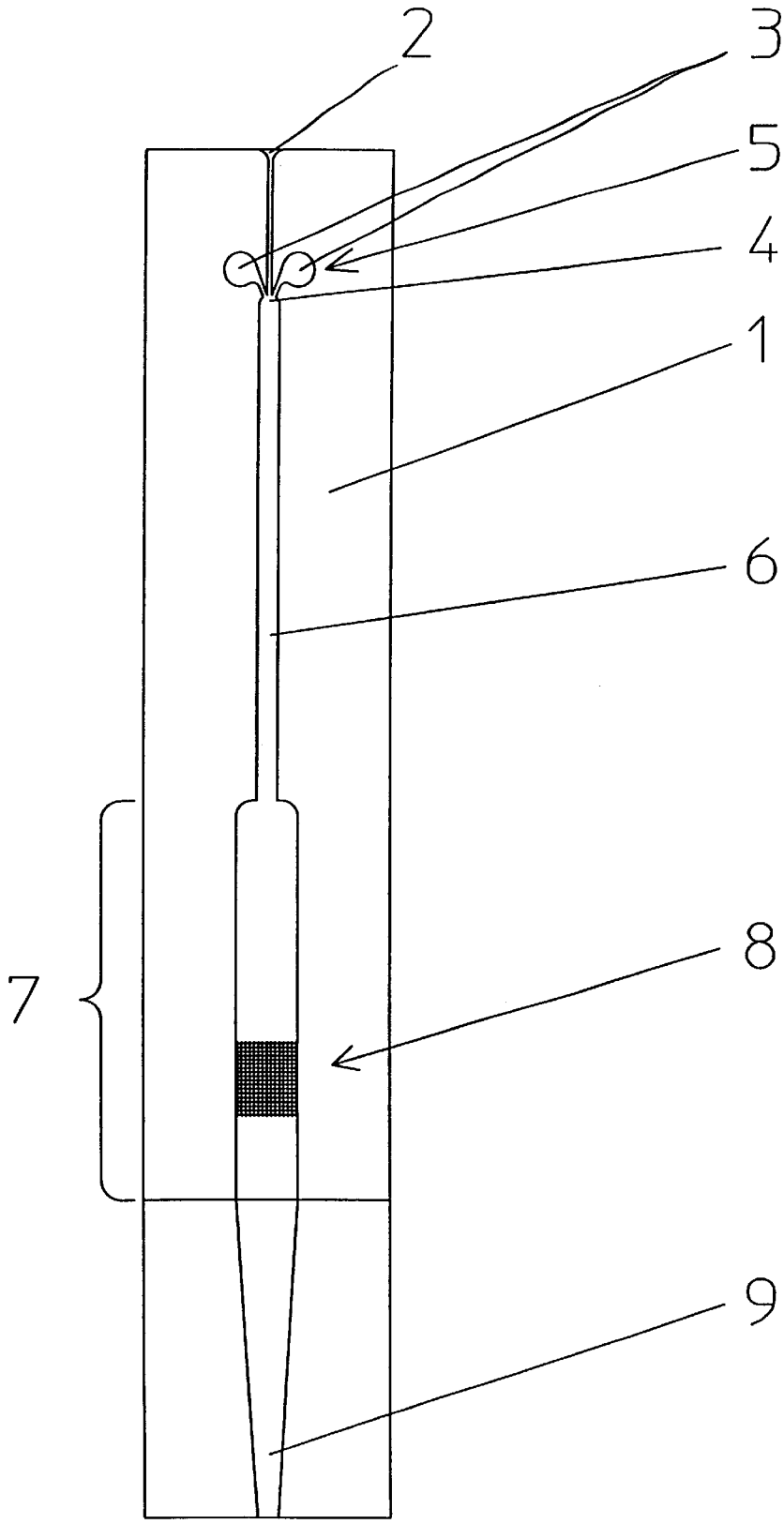
FIG. 1 is a top view on a body member of a texturing jet.

FIG. 1 is a top view on the body member 1 of a texturing jet. The thread to be textured is introduced into the texturing jet via a thread inlet duct 2. The jet body 5 is formed by feed ducts 3 for gaseous treatment medium. The treatment medium, preferably air or superheated vapor, is injected into the treatment duct 6 through feed ducts 3 at a very high speed so as to cause the generation of a twist on the exit site 4 of the jet body 5, by which the thread is accordingly deformed. In the retardation zone 7 of the treatment duct 6 is provided at least one vent portion 8 via which the injected gas is sucked off. It is there where the typical yarn crimp or socalled yarn plug is formed, which is drawn off via a guide part 9 and conducted over a cooling drum (not illustrated) before being finally coiled up. In order to achieve a braking effect for the textured yarn, the cross section of the duct may be designed to taper in the guide part 9. The cross section of the treatment duct 6 may be round, square or rectangular, varying in terms of dimension at least in partial regions between the entry and the exit of the filamentary material to be treated.

Figure 2:
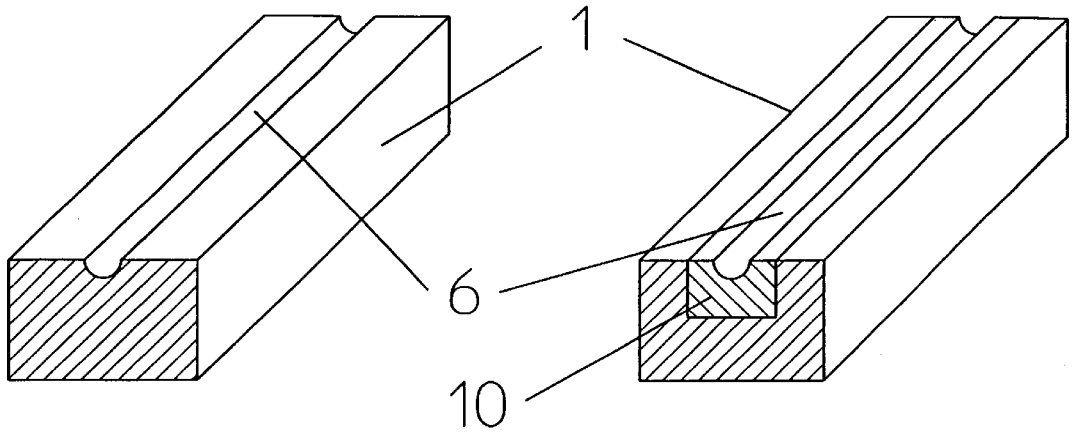
FIG. 2 is a perspective view in the unfolded state of a texturing jet comprised of two body members.

FIG. 2 depicts a texturing jet comprised of two body members 1 in the unfolded state. The two body members 1 of the texturing jet may be closed manually, pneumatically, hydraulically or electrically. The two body members 1, as a rule, are not symmetrically designed. It is more advantageous to provide the treatment duct 6 in only one of the body members 1 of the texturing jet and make the opposite body member plane. The treatment duct 6 advantageously is formed with a more resistant material than the body member 1 at least in partial regions, whereby any detrimental influence by the treatment medium is largely avoided. A coating or lining of a more resistant material such as, for instance, ceramics may, thus, be realized. In the right-hand part of FIG. 2, the treatment duct 6 is formed by an insert 10 provided to form the previously mentioned coating or lining and made of a resistant material and inserted in an appropriate recess of the body member 1. Suitable materials include tool steel or ceramic materials. The insert 10 may be connected with the body member 1 by appropriate pins or screw connections. A resilient mounting of the insert offers advantages, since an optimum application pressure will be created as the body members 1 of the texturing jet are being assembled. The coating, lining or insert 10 also may be provided only in partial regions of the treatment duct 6. What is important is the provision of a more resistant execution in those regions where the treatment duct 6 widens, i.e., where the thread is crimped, since the wear of the wall of the treatment duct 6 is the largest in those regions.

Figures 3, 4, 5:
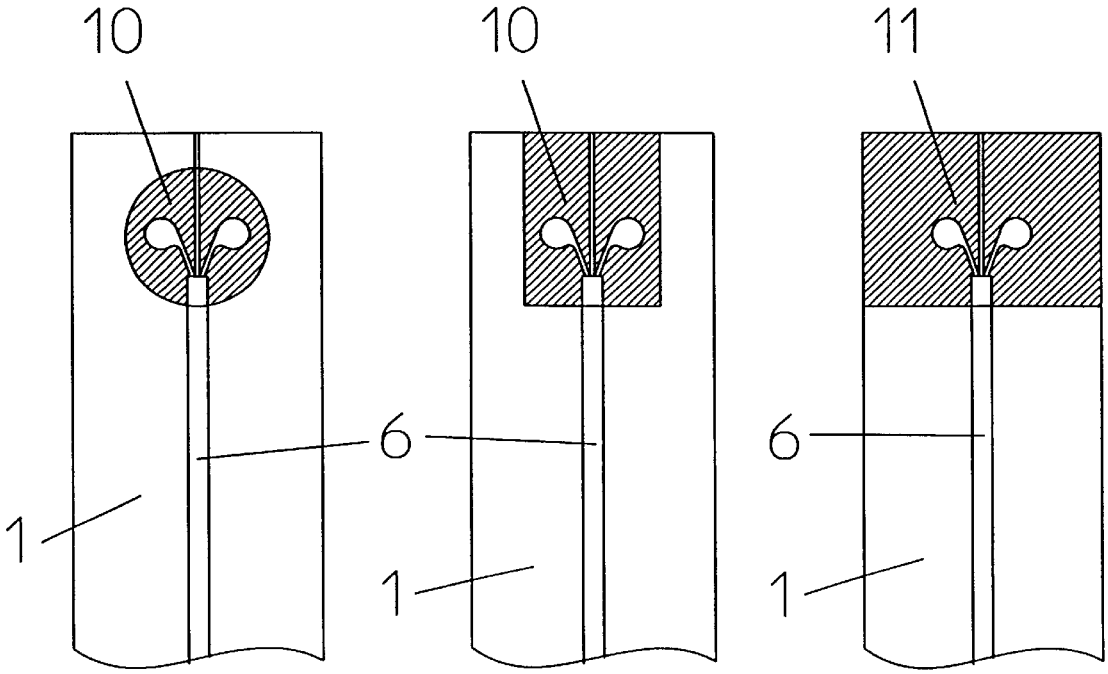
FIGS. 3 to 5 are each a top view on part of the body member or cover plate of a texturing jet in which the jet body is configured as an insert or an attachment, respectively.

According to FIG. 3, the insert 10 contains the jet body 5 of the texturing jet. The insert 10 is inserted into the body member 1 perpendicular to the longitudinal direction of the treatment duct 6, and accordingly screwed or connected therewith. Another option would be a magnetic connection between the body member 1 and the insert 10. In the variant according to FIG. 4, the jet body 5 likewise is contained in the insert 10, yet inserted in the body member 1 at the thread inlet duct 2 in the longitudinal direction of the same. In the variant according to FIG. 5, the jet body 5 is contained in an attachment 11. The attachment 11 is attached to the entry-side end side of the body member of the texturing jet. In a manner similar to the shown inserts 10 or attachment 11 forming the jet body 5, these may also form the treatment duct 6 or parts of the same. Thus, wear parts of the texturing jet may be exchanged simply and quickly, or the texturing jet may be readily adapted to varying yarn properties.

Figure 6:
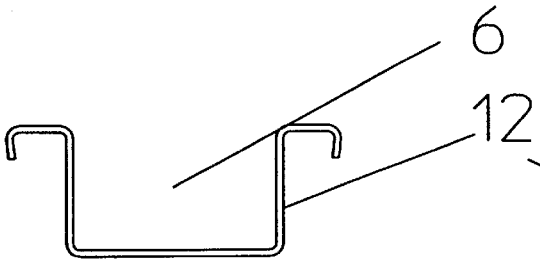
FIGS. 6 to 8 each illustrate a perforated plate forming the vent portion viewed in the direction of the duct, in top view and in side view.
Figure 8:
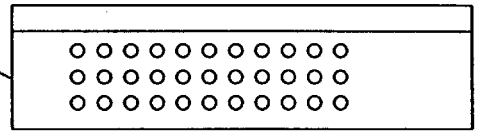
Figure 7:
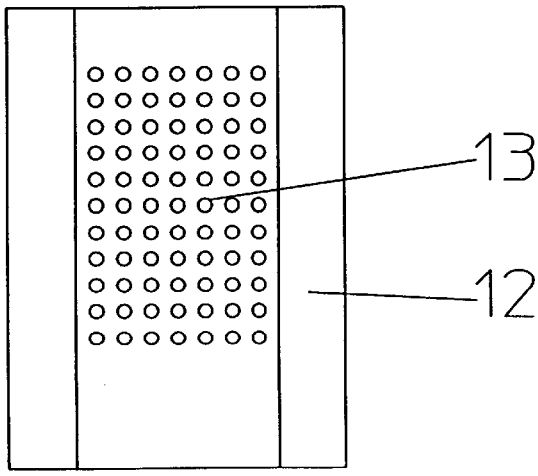

FIGS. 6 to 8 illustrate a perforated plate 12 which is inserted in the retardation zone 7 of the treatment duct 6 so as to form the vent portion 8 of the texturing jet. With a square cross section of the treatment duct 6, two of such perforated plates 12 are arranged within the treatment duct 6. Optimum air exhaustion is thereby ensured on all four sides of the treatment duct 6, thus imparting particularly symmetrical properties on the yarn. The holes 13 provided in the perforated plate 12 may be replaced with slots, which are, however, disadvantageous as compared to holes 13 in the event of particularly thin plates. On the other hand, the holes 13 are more prone to contamination. The perforated plates 12 may be connected with the body member 1 by suitable magnets provided in the body member 1 of the texturing jet. It is also possible to provide inserts with appropriate perforations (not illustrated) instead of the perforated plates 12.

Figure 9:
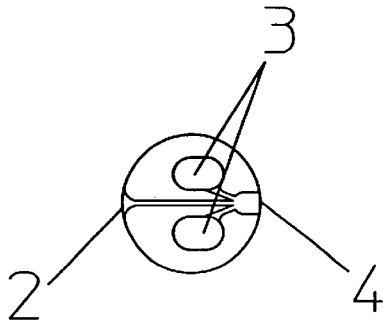
FIG. 9 is a top view on an insert containing the jet body.

FIG. 9 shows an exemplary embodiment of a round insert 10 forming the jet body 5 of a texturing jet, which comprises a feed duct 3 for the gaseous treatment medium on each side of the thread duct. Due to the jet body 5 being designed as an insert 10, the rapid and simple exchange of the same is feasible in case of wear. A replacement of the insert is feasible also if different yarn properties are desired. The insert 10 is made of a more resistant material than the body member 1. The insert 10 may be made of ceramic materials. In order to obtain defined yarn properties, the feed ducts 3 may also be designed asymmetrical. It is only by the configuration of the jet body 5 as an insert 10 that such alterations aimed at the obtainment of different yarn properties do make sense.

Figure 10:
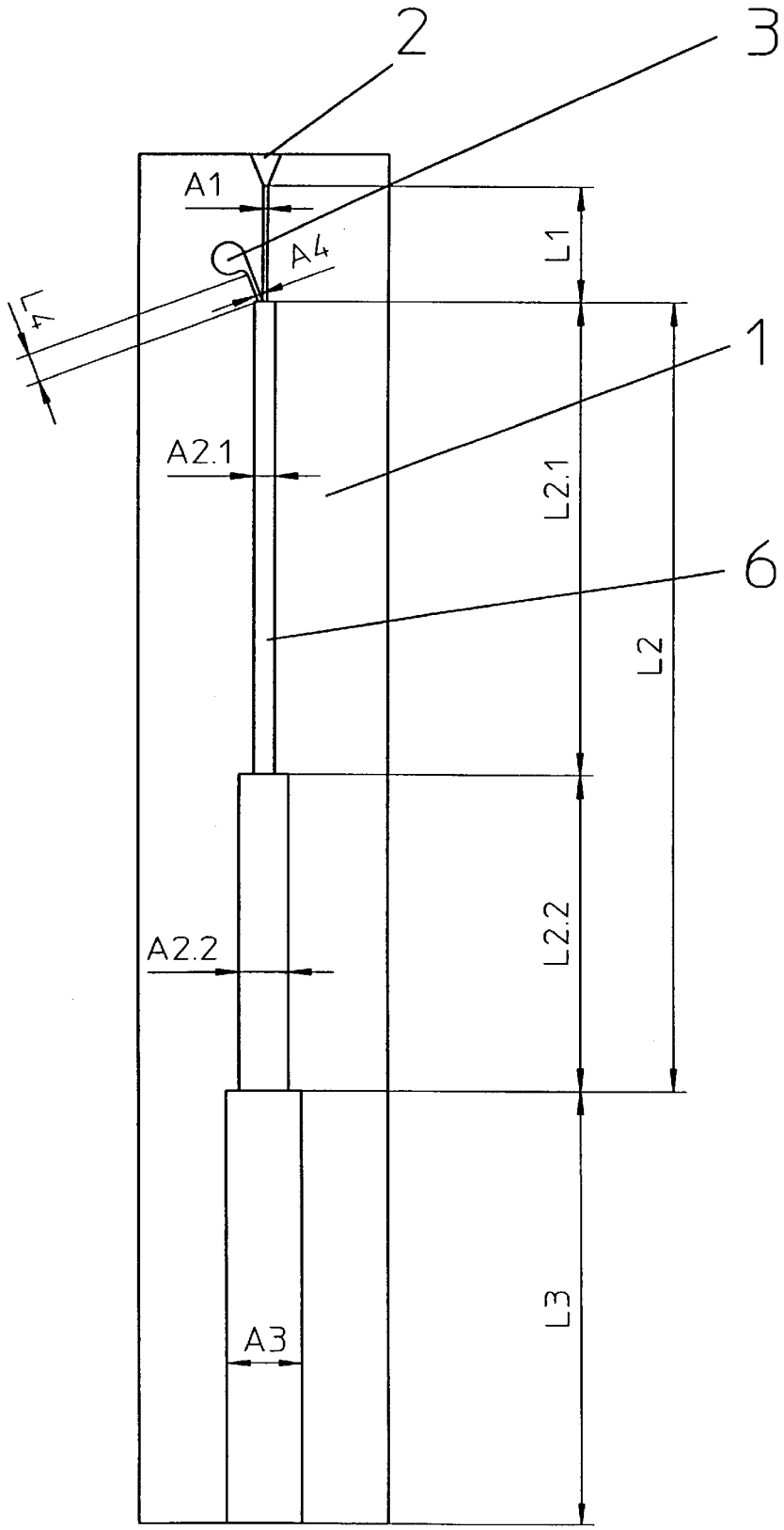
FIG. 10 is a schematic top view on a texturing jet.

FIG. 10 is a schematic top view on a body member 1 of a texturing jet with the longitudinal and cross sectional regions of the treatment duct 6 being indicated. Therein, the cross section A1 and the length L1 of the thread duct upstream of the jet body 5, the cross section A2.1 and the length L2.1 of the treatment duct 6 immediately following the jet body 5 and, after this, the cross section A2.2 and the length L2.2 of the treatment duct 6 as well as, subsequently, the cross section A3 and the length L3 of the treatment duct 6 are indicated. The cross section and the length of the feed duct 3 for the injected air are denoted by A4 and L4, respectively. Based on the cross section A2.1, the preferred relative cross sections are as follows:

| | |
|---|---|
| A1 | 0.2 to 0.4 |
| A2.1 | 1 |
| A2.2 | 1.5 to 3.5 |
| A3 | 3 to 8 |
| A4 | 0.4 to 0.8 |

Based on the length L2, the preferred relative lengths are as follows:

| | |
|---|---|
| L1 | 5 to 25% |
| L2 | 100% |
| L2.1 | 20 to 70% |
| L2.2 | 30 to 90% |
| L3 | 10 to 120% |
| L4 | 0.5 to 10% |

As already mentioned above, the yarn downstream of the texturing jet runs over a cooling drum and subsequently is wound on appropriate reels, thus being available for further processing. In doing so, it is advantageous to keep the distance between the texturing jet and the cooling drum as short as possible. Advantageously, the guide part following the texturing jet may, thus, be designed to be asymmetrical and the texturing jet may be approached to the cooling drum so as to form the other part of the guide. Advantageously, the plug after having run through a die part is directly supplied to the cooling drum and the speed of the plug is controlled by the speed of the cooling drum. In order to fix the plug on the cooling drum, a multiple loop is usually effected.

Figure 11B:
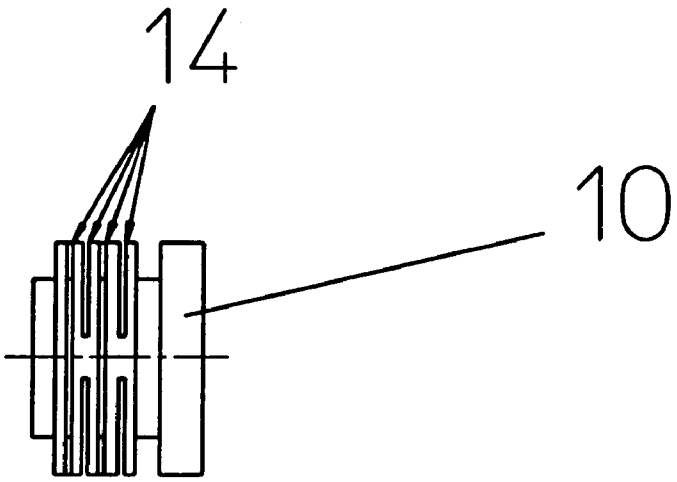
FIGS. 11*a* and 11*b* are a top view and a side view, respectively, of a resiliently acting insert.
Figure 11A:
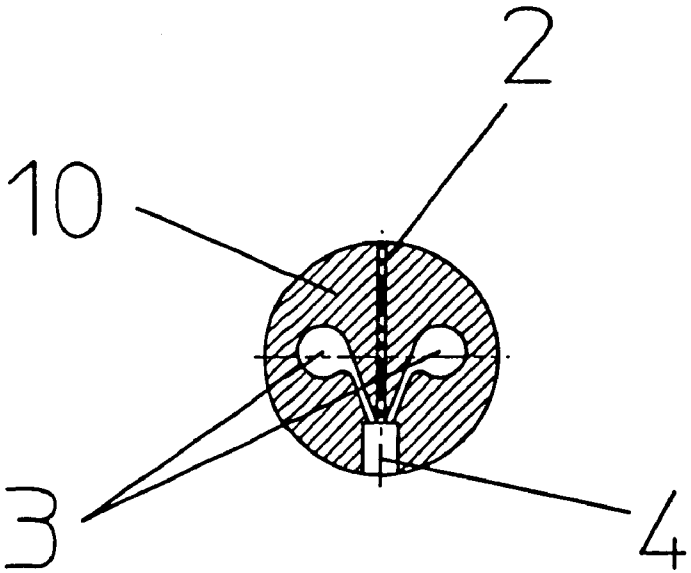

FIGS. 11*a* and 11*b* are a top view and a side view, respectively, of a circular insert 10 intended to form the jet body 5 of a texturing jet. To both sides of the thread inlet duct 2 are connected feed ducts 3 for the gaseous treatment medium. The twisted thread is conducted further on the exit site 4. As is apparent from FIG. 11*b*, the insert 10 comprises a number of indents 14 or the like, which are configured to exert a resilient action upon insertion of the insert 10 in the body member 1 of the texturing jet.

Figures 12A, 12B:
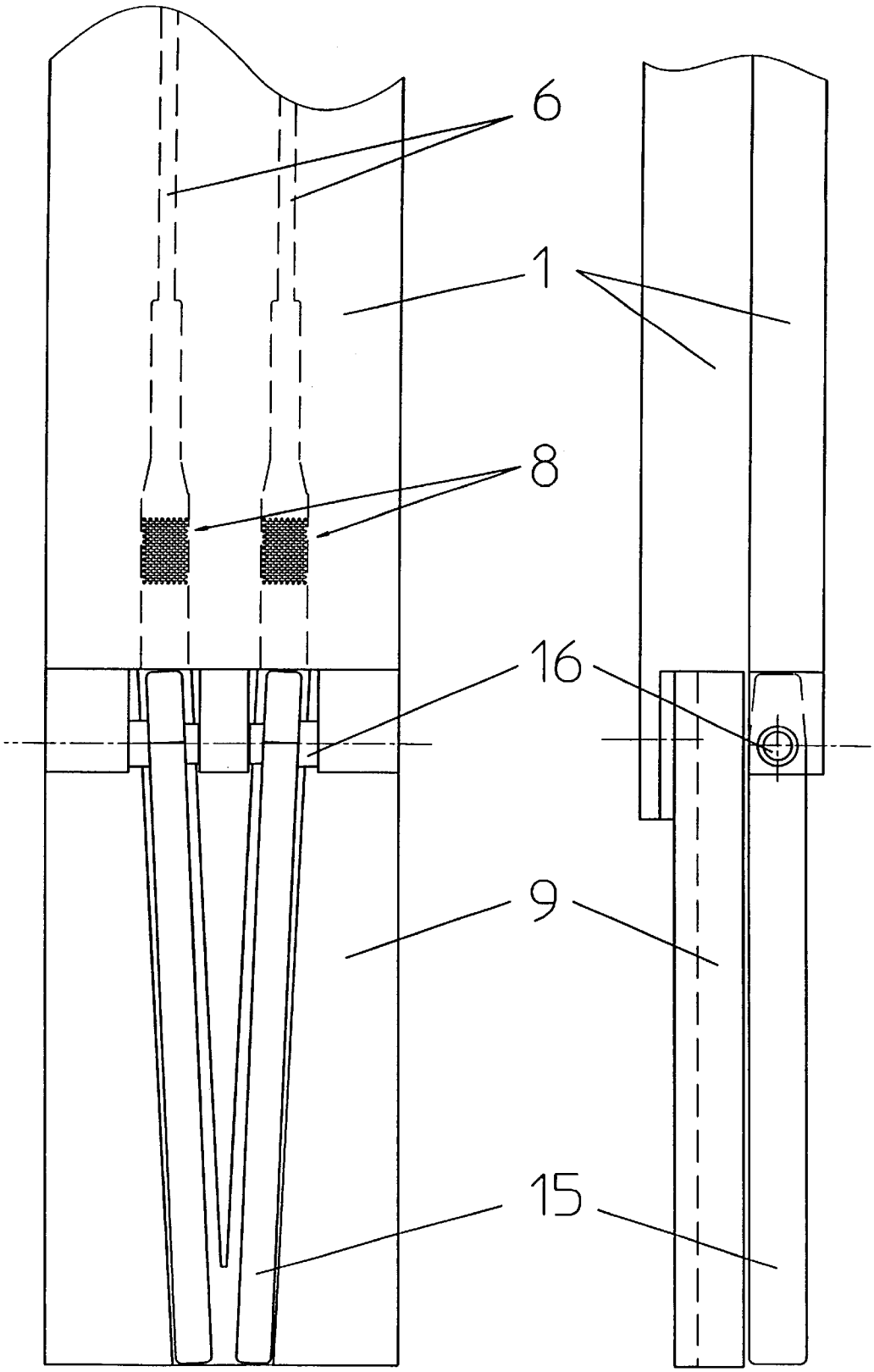
FIGS. 12*a* and 12*b* are a top view, and a side view, respectively, of a texturing jet comprising a die part connected thereto.

FIGS. 12*a* and 12*b* illustrate a texturing jet comprised of two superimposed body members 1 and a consecutive die or guide part 9. The texturing jet illustrated is designed for the fabrication of two yarns at the same time. The two parallelly arranged treatment ducts 6 as well as the parallelly arranged vent portions 8 are entered in broken lines. To each vent portion 8 is connected a duct of the guide part 9, in which the yarn plug is advanced until it is finally wound around a cooling drum (not illustrated). In the guide part 9, the yarn plugs are guided through braking rails 15 pivotably mounted by means of joints 16 before they are supplied to the cooling drum (not illustrated). The guide part 9 also may be produced in one piece with a body member 1 of the texturing jet.

What I claim is:

1. A texturing jet arrangement for treatment of a filamentary material of the type including at least two superimposed body members, a treatment duct formed in at least one body member to extend between said superimposed body members, at least one jet body for feeding of a gaseous treatment medium and at least one vent portion provided in said treatment duct, wherein said treatment duct comprises at least a partial region having a material that is more wear-resistant than the material of said body member.

2. A texturing jet arrangement as set forth in claim 1, wherein said more wear-resistant material is comprised of a ceramic material.

3. A texturing jet arrangement as set forth in claim 1, wherein said more wear-resistant material is provided by an insert inserted in a body member.

4. A texturing jet arrangement as set forth in claim 1, wherein said more wear-resistant material is provided by an attachment attached to a body member.

5. A texturing jet arrangement as set forth in claim 3, wherein said at least one jet body is contained in said insert.

6. A texturing jet arrangement as set forth in claim 4, wherein said at least one jet body is contained in said attachment.

7. A texturing jet arrangement as set forth in claim 3, wherein said insert is resiliently mounted in a body member means.

8. A texturing jet arrangement as set forth in claim 7, further comprising indents provided in said insert for realizing said wear-resilient mounting.

9. A texturing jet arrangement as set forth in claim 1, wherein said treatment duct has a square cross section in said vent portion and comprises aeration windows formed by perforated plates provided on each side of said treatment duct.

10. A texturing jet arrangement as set forth in claim 9, further comprising magnets for fastening said perforated plates to said body member.

11. A texturing jet arrangement as set forth in claim 1, further comprising a treatment duct runout means and a die part connected to said treatment duct runout means for directly supplying said filamentary material to a cooling drum after treatment thereof.

12. A texturing jet arrangement as set forth in claim 1, further comprising a treatment duct runout means and a die part integrated in said texturing jet for directly supplying said filamentary material to a cooling drum after treatment thereof.

* * * * *

UNITED STATES PATENT AND TRADEMARK OFFICE

CERTIFICATE OF CORRECTION

PATENT NO. : 6,308,388 B1
DATED : October 30, 2001
INVENTOR(S) : Bruno Haider

It is certified that error appears in the above-identified patent and that said Letters Patent is hereby corrected as shown below:

Title page,
-- [30] Foreign Application Priority Data
Jan. 12, 2000 [AT] Austria …….. A37/2000 --

Signed and Sealed this

Twenty-fourth Day of September, 2002

*Attest:*

*Attesting Officer*

JAMES E. ROGAN
*Director of the United States Patent and Trademark Office*